US006382827B1

(12) United States Patent
Gebrian

(10) Patent No.: US 6,382,827 B1
(45) Date of Patent: May 7, 2002

(54) METHOD AND APPARATUS FOR MIXING LIQUID SOLUTIONS USING A ROTATING MAGNET TO GENERATE A STIRRING VORTEX ACTION

(75) Inventor: Peter Louis Gebrian, Wilmington, DE (US)

(73) Assignee: Dade Behring Inc., Deerfield, IL (US)

( * ) Notice: Subject to any disclaimer, the term of this patent is extended or adjusted under 35 U.S.C. 154(b) by 0 days.

(21) Appl. No.: 09/703,139

(22) Filed: Nov. 1, 2000

(51) Int. Cl.[7] ..... B01F 13/08
(52) U.S. Cl. ..... 366/274
(58) Field of Search ..... 366/273, 274, 366/348; 416/3; 422/99; 435/302.1

(56) References Cited

U.S. PATENT DOCUMENTS

| | | | | |
|---|---|---|---|---|
| 2,844,363 | A | * | 7/1958 | Clark |
| 2,951,689 | A | * | 9/1960 | Asp et al. |
| 3,088,716 | A | * | 5/1963 | Stott |
| 3,356,346 | A | * | 12/1967 | Landsberger |
| 3,503,592 | A | * | 3/1970 | Taylor, Sr. et al. |
| 3,595,531 | A | * | 7/1971 | Williams et al. |
| 3,749,369 | A | * | 7/1973 | Landsberger |
| 3,831,903 | A | * | 8/1974 | Harmel, Jr. |
| 3,997,272 | A | * | 12/1976 | George |
| 4,162,855 | A | | 7/1979 | Bender |
| 4,390,283 | A | * | 6/1983 | Meyer |
| 4,477,192 | A | * | 10/1984 | Bonney |
| 4,534,656 | A | | 8/1985 | De Bruyne |
| 4,665,736 | A | * | 5/1987 | Yokoyama et al. |
| 4,720,025 | A | * | 1/1988 | Tatevosian et al. |
| 4,728,500 | A | | 3/1988 | Higo |
| 4,876,069 | A | * | 10/1989 | Jochimsen |
| 5,078,969 | A | | 1/1992 | Bacus |
| 5,272,092 | A | * | 12/1993 | Hamasaki et al. |
| 5,529,391 | A | * | 6/1996 | Kindman et al. |
| 5,547,280 | A | | 8/1996 | Wanninger et al. |
| 5,578,201 | A | * | 11/1996 | Collier et al. |
| 5,586,823 | A | | 12/1996 | Carr |

FOREIGN PATENT DOCUMENTS

| | | | |
|---|---|---|---|
| DE | 3344754 | * | 6/1985 |
| GB | 2082929 | * | 3/1982 |
| JP | 63-185435 | * | 8/1988 |
| JP | 1-310514 | * | 12/1989 |

* cited by examiner

*Primary Examiner*—Charles E. Cooley
(74) *Attorney, Agent, or Firm*—Leland K Jordan

(57) ABSTRACT

A method for rapidly mixing a liquid solution in a sample container by causing a small magnetic mixing member to rapidly revolve or orbit the container's axis within the solution in a generally circular pattern in response to a revolving magnetic field positioned in close proximity to the sample container.

9 Claims, 10 Drawing Sheets

METHOD AND APPARATUS FOR MIXING LIQUID SOLUTIONS USING A ROTATING MAGNET TO GENERATE A STIRRING VORTEX ACTION

FIELD OF THE INVENTION

The present invention relates to a method and apparatus for uniformly mixing sample liquids, reagents or other solutions. In particular, the present invention provides a method for rapidly and uniformly mixing a liquid by generating a vortex mixing action using magnetic mixing.

BACKGROUND OF THE INVENTION

Automated microbiology and clinical chemistry analyzers identify the presence of microorganisms and analytes in body fluids such as urine, blood serum, plasma, cerebrospinal fluid, sputum and the like. Automated microbiology and clinical chemistry analyzers improve productivity and enable the clinical laboratory to meet the workload resulting from high-test volume. Automated systems provide faster and more accurate results as well as valuable information to clinicians with regard to the types of antibiotics or medicines that can effectively treat patients diagnosed with infections or diseases. In a fully automated analyzer, many different processes are required to identify microorganisms or analytes and an effective type of antibiotic or medicine. Throughout these processes, patient sample liquids and samples in combination with various liquid reagents and antibiotics, are frequently required to be mixed to a high degree of uniformity producing a demand for high speed, low cost mixers that occupy a minimal amount of space. In addition to identifying microorganisms, most automated microbiology systems in particular can also determine the types of antibiotics as well as the minimum inhibitory concentration levels of these antibiotics (MIC) that are required to inhibit microbial growth.

Analyzers like those described above perform a variety of analytical processes upon microbiological liquid samples and in most of these, it is critical that a patient's biological sample, particularly when in a liquid state, be uniformly mixed with analytical reagents or diluent or other liquids or even rehydrated compositions and presented to an analytical module in a uniformly mixed state. In a biochemical analyzer, other liquids like broth may need to be uniformly stirred before being used. Various methods have been implemented to provide a uniform sample solution mixture, including agitation, mixing, ball milling, etc. One popular approach involves using a pipette to alternately aspirate and release a portion of liquid solution within a liquid container. Magnetic mixing, in which a vortex mixing action is introduced into a solution of liquid sample and liquid or non-dissolving reagents, herein called a sample liquid solution, has also been particularly useful in clinical and laboratory devices.

U.S. Pat. No. 5,586,823 describes a magnetic stirrer comprising a bottle unit constituted by a bottle having a base and a stirrer bar of relatively low power magnetization lying on the bottle base within the bottle, and a permanent magnet means of relatively high power located beneath the bottle base in close proximity thereto, and driving means for continuously rotating the external permanent magnet means about an axis substantially normal to the bottle base so that its rotating strong magnetic field entrains the stirrer bar in continuous rotation in a plane parallel to and above the bottle base within the liquid in the container.

U.S. Pat. No. 5,547,280 discloses a two-part housing magnetic stirrer having a lower part contains a drive while the upper part forms the mounting surface for a mixing container that holds a mixing magnet, and the separating surface of the upper and lower parts runs approximately horizontal when in the working position. The upper part is made of glass and the of this upper part, when in its working position, is tightly pressed against an opposing surface of the lower part. The edge can have a widening that engages into a corresponding undercut of the lower part. This provides a magnetic stirrer that is tightly sealed and impervious to aggressive vapors.

U.S. Pat. No. 5,078,969 discloses a stirrer which is placed on a reaction vessel and used for the staining of biological specimens on microscope slides in a jar. The bottom wall of the jar is perforated and made of glass so that the magnetic flux passes through to couple a stirrer rod to a magnetic drive arm. The jar is seated on a platform with the magnetic-stirrer drive mounted and operable below the platform. The magnetic drive has a motor with magnetic drive arm like a permanent magnetic and a variable speed control device to control the angular velocity of the magnetic arm.

U.S. Pat. No. 4,728,500 discloses a stirrer for biochemical reactions comprising a magnetically permeable vessel containing at least one magnetic bead and a magnetic device having a spacer with a number of longitudinally positioned magnetic bars parallel to one another disposed thereon. The bars may be moved in a longitudinal direction so as to produce an oscillating magnetic field causing the beads to undergo an elliptic motion.

U.S. Pat. No. 4,534,656 discloses a magnetic stirrer apparatus in which the stirrer is buoyant, and thereby floats on the surface of a liquid which is to be stirred. The stirrer is caused to be rotated, generally on the vertical axis of the flask, and is enabled to change its elevation, relative to the bottom of the flask, as the level of liquid in the flask is changed. The floating stirrer is restricted by a guide rod to rotational movement, and to vertical movement as the liquid level changes; a magnetic drive is provided to cause rotational movement of the stirrer, to thereby cause mixing action of the entire body of liquid in the flask, due in part to viscous drag. The guide rod is preferably a non-circular driving guide rod which is suspended from the underside of a closure provided for the upper opening of the flask, and a magnetic drive apparatus causes rotation of the driving guide rod, the apparatus comprising a magnet on the driving guide rod within the flask, and a motor-driven magnet carried on the exterior of the closure or cover for the flask.

U.S. Pat. No. 4,162,855 discloses a magnetic rotor having a central hub which has a surface covered with an inherently high lubricity material and on which is mounted a radially extending magnetic impeller. The magnetic rotor is mounted in a central collar portion of a cage which has a number of frame members extending from the collar to prevent the rotating impeller from engaging the walls of the vessel. As the outward members maintain the cage in position within the vessel, the magnetic rotor is allowed to "float" relative to the cage and rotate freely, with extremely low frictional forces, relative to the vessel to agitate the substance therein.

Accordingly, from a study of the different approaches taken in the prior art to the problems encountered with magnetic mixing of small volume solutions, taken with the challenges of maintaining a high level of sterilization and, at the same time, minimizing the physical size of a magnetic mixer, there is a need for an improved approach to the design of a simplified, space-efficient magnetic vortex mixer. In particular, there is a need for a mixer which enables uniform mixing of liquid solutions contained in tubes held in a sample tube rack without removing the sample tubes from the rack thereby eliminating the need for costly, spacious mechanisms to move the tube to a separate location for mixing. There is a further need for a method for magnetic mixing that Is of such high speed that multiple mixing processes may be achieved without adversely affecting the time required for liquid solution analysis. There is a even further need for a method for magnetic mixing having a mixing member that is easily placed into a liquid solution container. There is an even further need for a method for magnetic mixing having a mixing member that has such a low manufacturing expense that it may be disposed after use without adversely affecting the cost of liquid solution analysis.

SUMMARY OF THE INVENTION

Many of these disadvantages to the prior art are overcome by using the apparatus and/or methods of this invention. This invention provides a method for mixing a liquid solution contained in a liquid container by causing a freely disposed, spherical mixing member to rapidly oscillate within the solution in a generally circular pattern within the container. The spherical mixing member is caused to rapidly move within the solution by revolving a magnetic field at high speed in a generally circular pattern in proximity to the liquid container. Magnetic forces acting upon the magnetic mixing member cause it to generate a mixing motion within the liquid solution. In one embodiment, the magnetic field source is caused to rotate by rotating a permanent or semi-permanent magnet at close proximity to the liquid container using a motor shaft having said magnetic field source attached thereto. In an alternate embodiment, multiple liquid solutions are mixed within respective liquid containers supported in a rack and the rack is moved through the revolving magnetic field while the containers remain within the rack. In an exemplary embodiment, the small magnetic mixing member is shaped like a spherical ball and may be automatically dispensed either at time of manufacture of the liquid solution container or loaded on-board the instrument into a liquid solution container easily. Additionally, a spherical mixing member may be produced in large quantities at very low cost so that is may be disposed after a single use in contrast to prior art stirring members that are typically expensive plastic-coated permanent magnets and are therefore repeatedly used. Repeated use of a plastic-coated permanent magnet or other more expensive mixing member introduces the possibility of adverse cross-contamination between stirrings.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
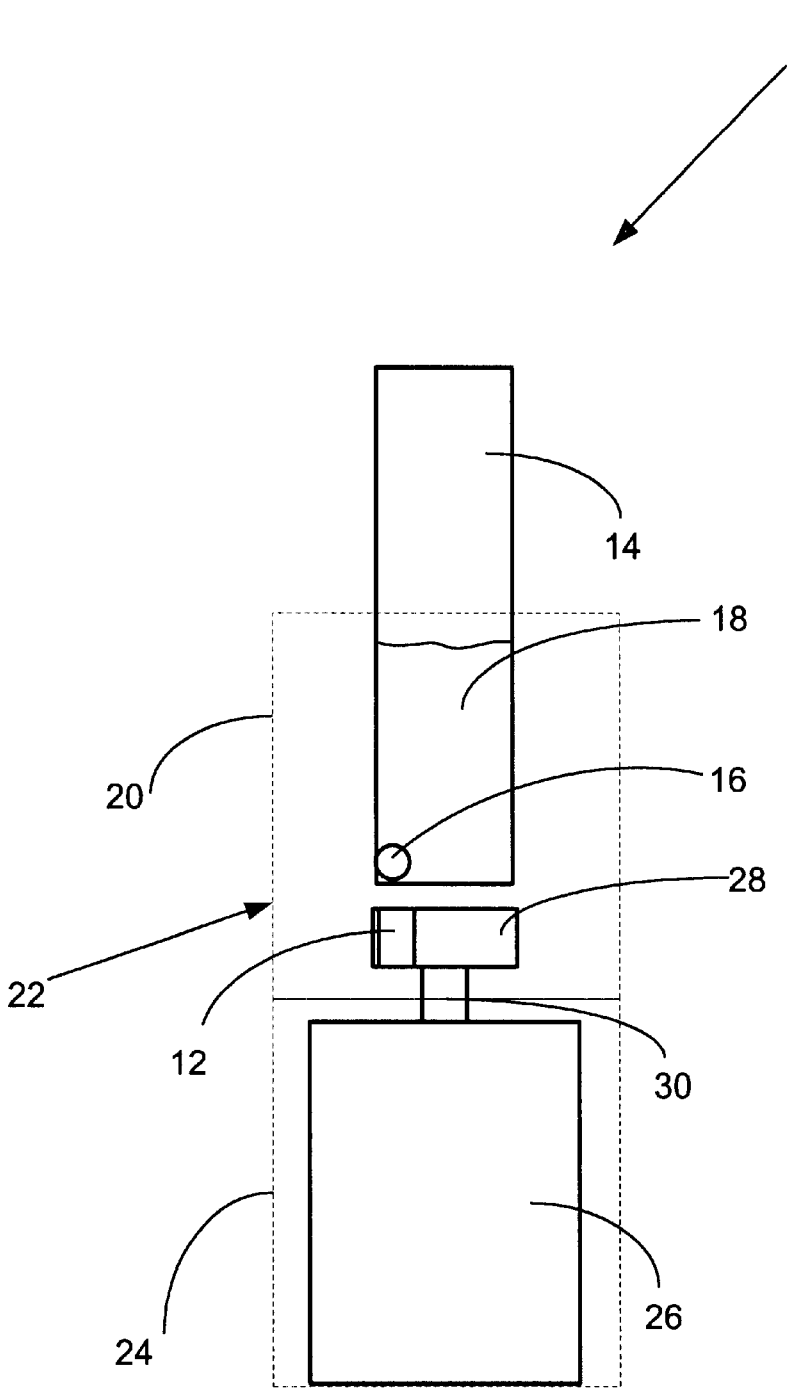
FIG. 1 is a schematic elevation view of a exemplary magnetic mixing apparatus that may be used to advantage in practicing the present invention.

FIG. 1 shows the elements of a magnetic mixing apparatus 10 comprising a source of a magnetic field 12 disposed proximate a liquid container 14 and having sufficient magnetic strength so that non-uniform magnetic forces acting on a mixing member 16 produced by revolving the magnetic field source 12 generate an effective mixing motion within a liquid solution 18 within the liquid container 14. When the magnetic field source 12 is revolved beneath or around the container 14, the mixing member 16 is caused to move so as to minimize the distance separating the mixing member 16 from the magnetic field source 12. A rotational movement of the magnetic field source 12 causes the mixing member 16 to similarly rotate within liquid 18 thereby generating a vortex-like mixing motion of liquid 18. Additionally, the present invention may be practiced by reversing or alternating the direction of rotational motion of the magnetic field source 12 during mixing to induce a shear-agitation mixing motion of liquid 18.

Figure 2:
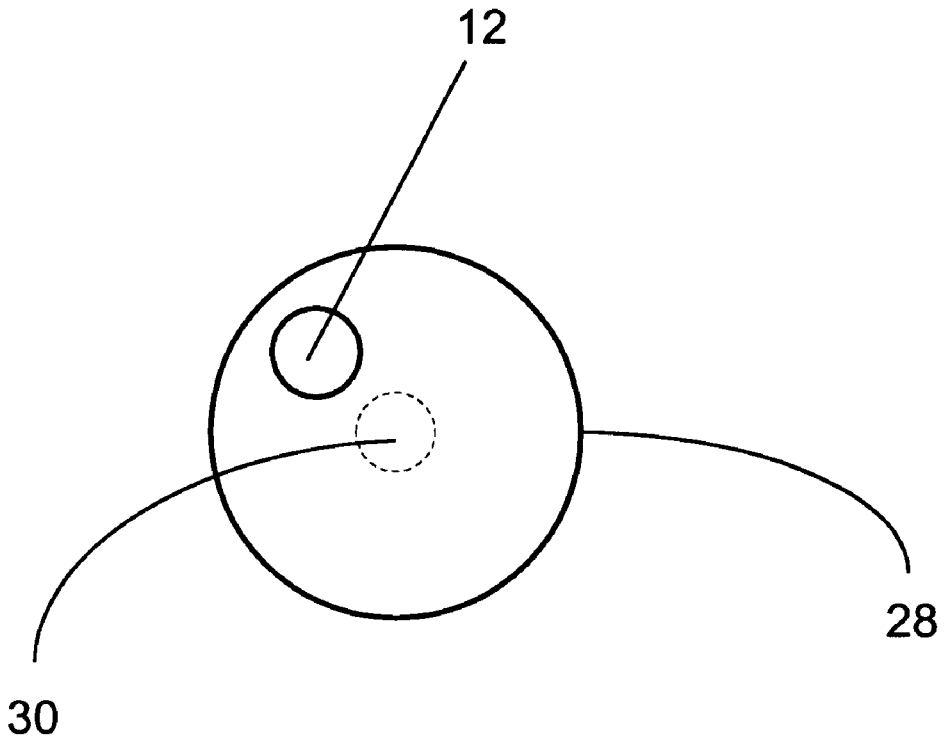
FIG. 2 is a top plan view of a mixing disk useful in practicing the invention of FIG. 1.
Figure 5:
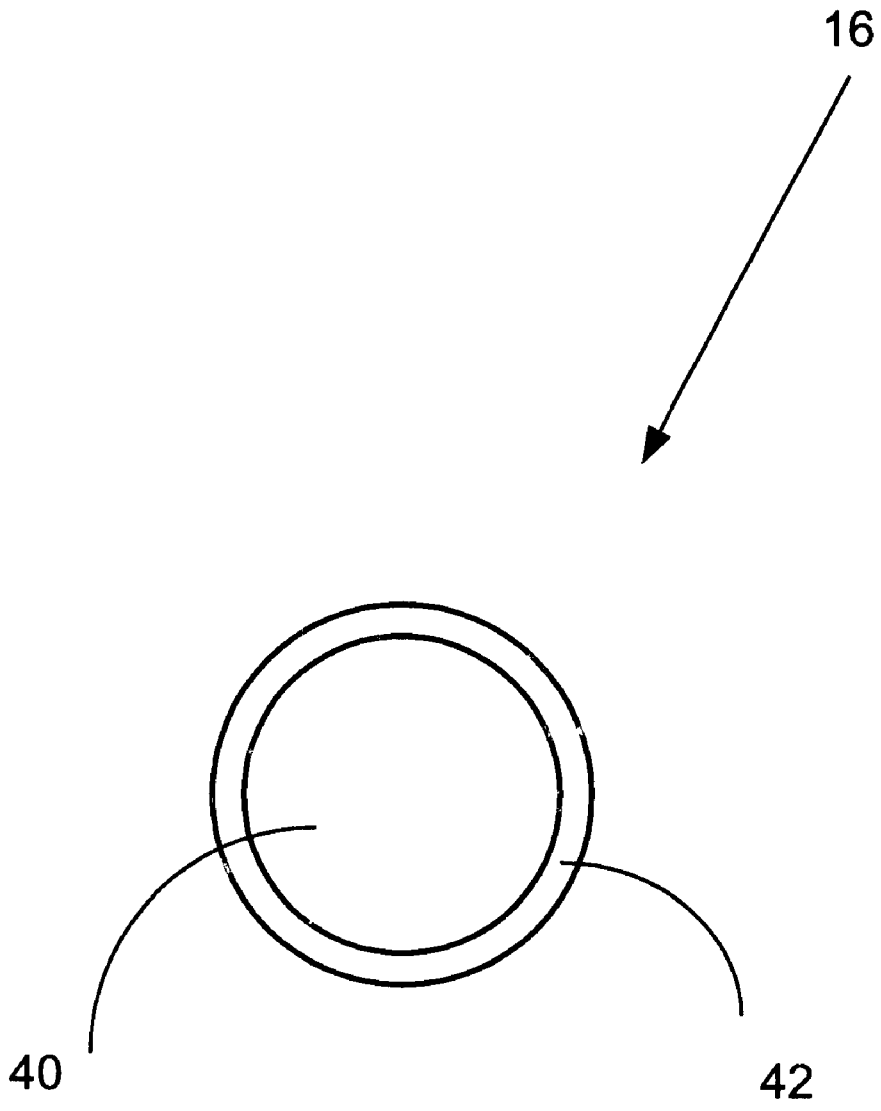
FIG. 5 is a cross-section view of a mixing member that may be employed to advantage in with the present invention.

Mixing member 16 is preferably small and of a spherical or similar shape and may be formed, for example, like a ball 16 of ferromagnetic or semi-ferromagnetic material (see FIG. 5). Hereinafter the term ferromagnetic is intended to mean a substance having a sufficiently high magnetic permeability to be positionally affected by an orbiting or rotating magnetic field. The term magnetic is likewise intended to mean a substance that is independently capable of generating a magnetic field. Liquid container 14 is of a nonmagnetic material and is supported in an upper portion 20 of a mixing stand 22 (illustrated in dashed lines for clarity purposes only), the mixing stand 22 also having with lower portion 24 designed to encase a motor 26 adapted to rotate a disk 28 encasing the magnetic field source 12 as shown. FIG. 2 is a top plan view of such a disk 28 encasing the magnetic field source 12. The rotating shaft 30 of motor 26, best seen in FIG. 1, is shown in dashed lines in FIG. 2.

It has been unexpectedly found that a highly effective mixing or agitation action occurs using the above described combination of the revolving magnetic field source 12 and a small, spherical mixing member 16 regardless of the relative sizes and locations of the magnetic field source 12, liquid container 14 and mixing member 16. In prior art mixers, it has generally been required that a mixing member be magnetic and of generally oblong or rectangular shape in order to be rotated by a magnetic field in order to impart a "paddle-like" motion to generate a vortex mixing action; however, such magnetic mixing members are expensive and complex to produce. Furthermore, it has generally been assumed that the centerline of rotation of a magnetic mixing member is required to be aligned with the centerline of rotation of the source of a rotating magnetic field in order to impart a vortex mixing action. What has been discovered is that use of a spherical ferromagnetic mixing member 16 in a liquid container in conjunction with an rotating magnet field allows much greater flexibility in positioning and operating the source of the magnetic field and the location of the liquid being mixed.

Figure 3:
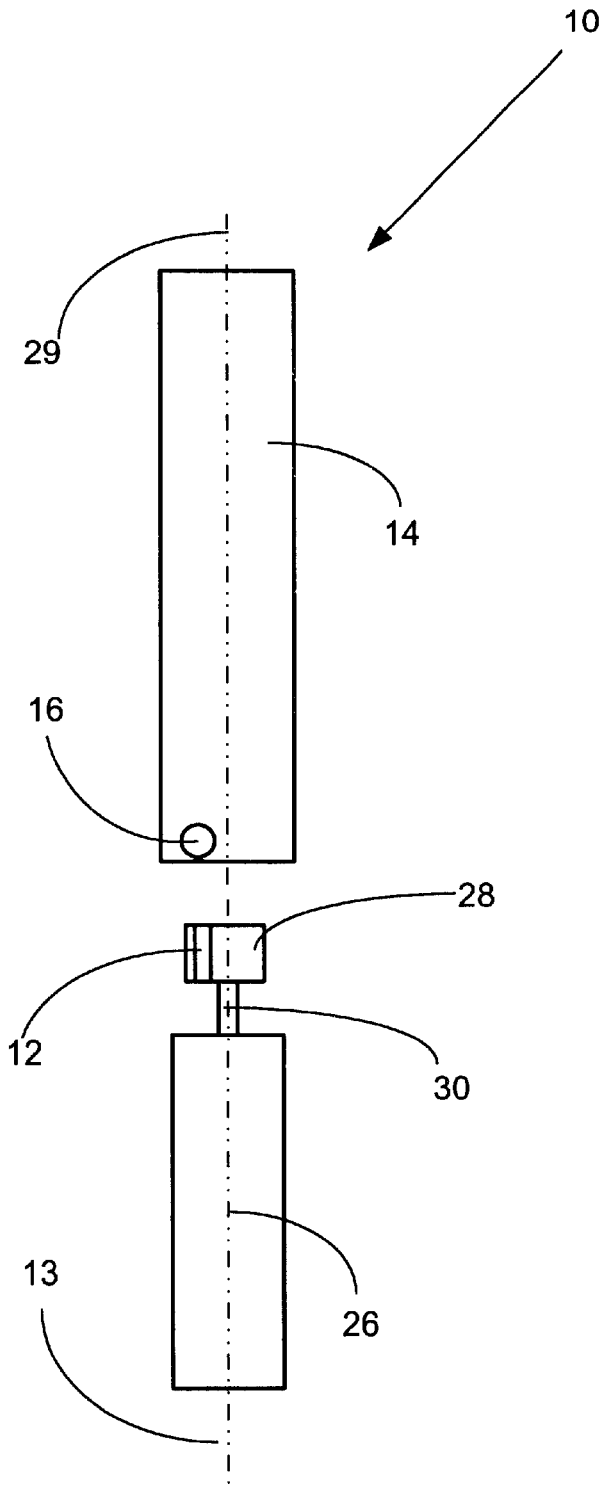
FIG. 3 is a schematic elevation view of a first alternate magnetic mixing apparatus that may be used to advantage in practicing the present invention.

FIG. 1 illustrates an embodiment wherein the diameter of rotation of the mixing member is similar in size to the diameter of the liquid container 14. In an alternate embodiment of the present invention, FIG. 3 illustrates an mixing apparatus 10 wherein the diameter of rotation of the mixing member is significantly smaller in size to the diameter of the liquid container 14 and wherein the centerline axis 29 of the disk 28 and the centerline axis 13 of the magnetic field source 12 respectively, are aligned. Depending upon the strength of the magnetic field source 12, the arrangement of FIG. 3 has also been found to be effective in producing a uniformly mixed liquid solution 18 possibly however requiring a longer time than for an embodiment like that shown in FIG. 1.

Figure 4:
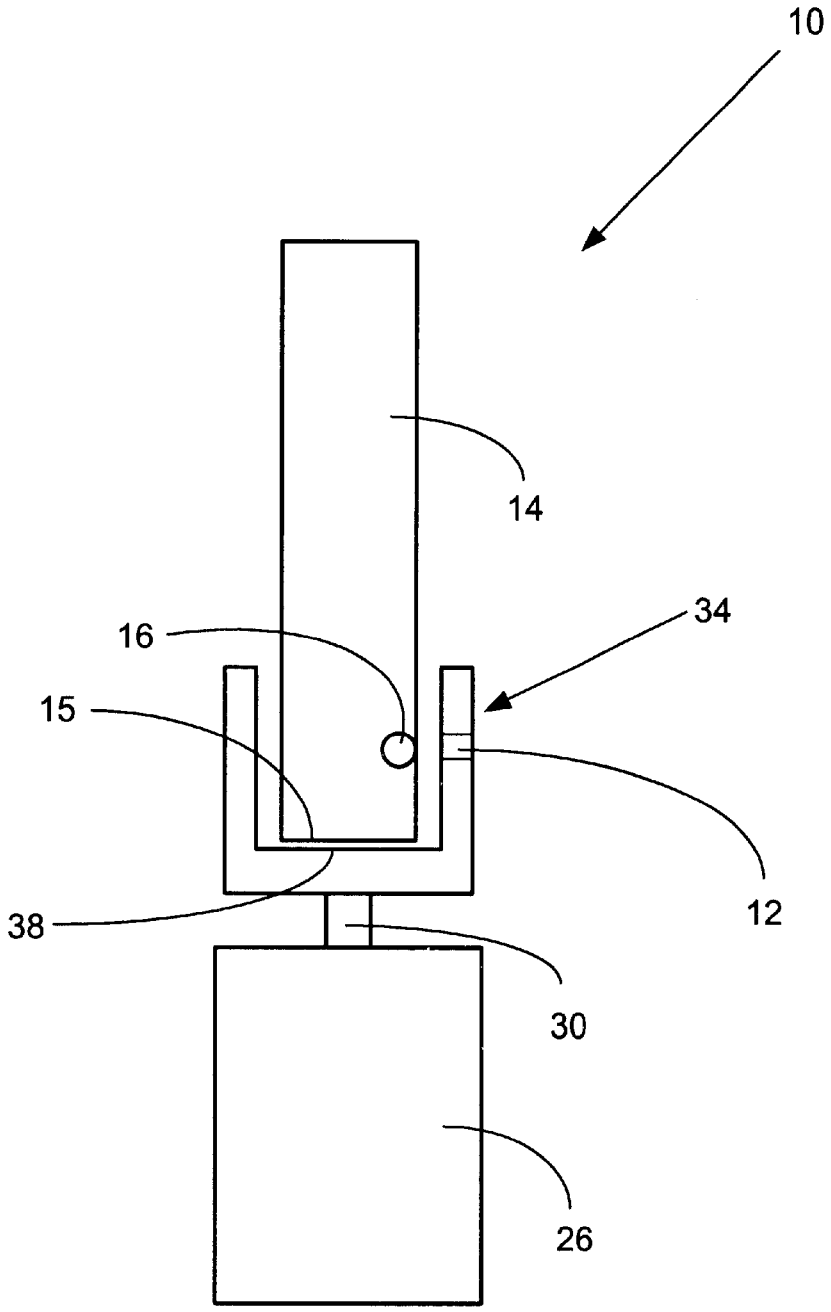
FIG. 4 is a schematic elevation view of a second alternate exemplary magnetic mixing apparatus that may be used to advantage in practicing the present invention with a U-shaped bracket.
Figure 4A:
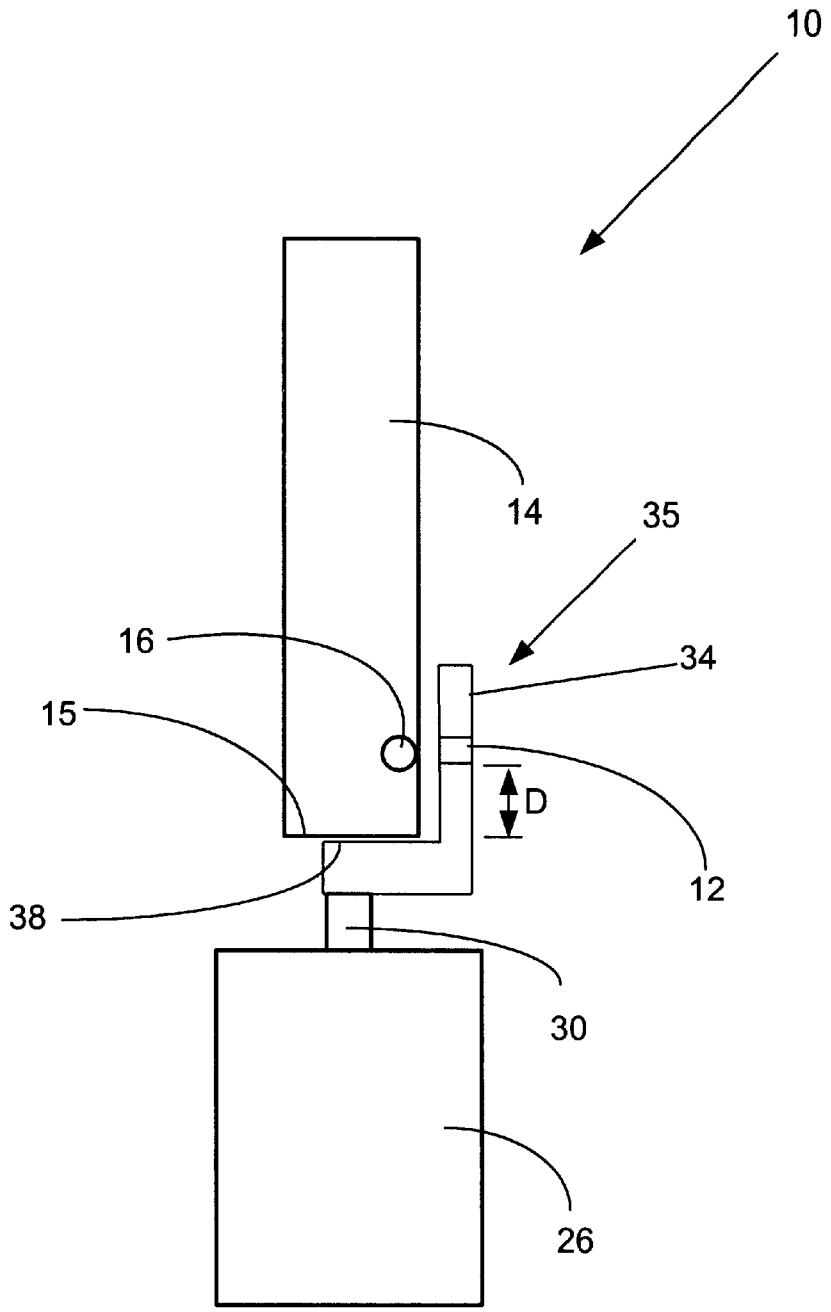
FIG. 4A is a schematic elevation view of another alternate exemplary magnetic mixing apparatus that may be used to advantage in practicing the present invention with an L-shaped bracket.
Figure 4B:
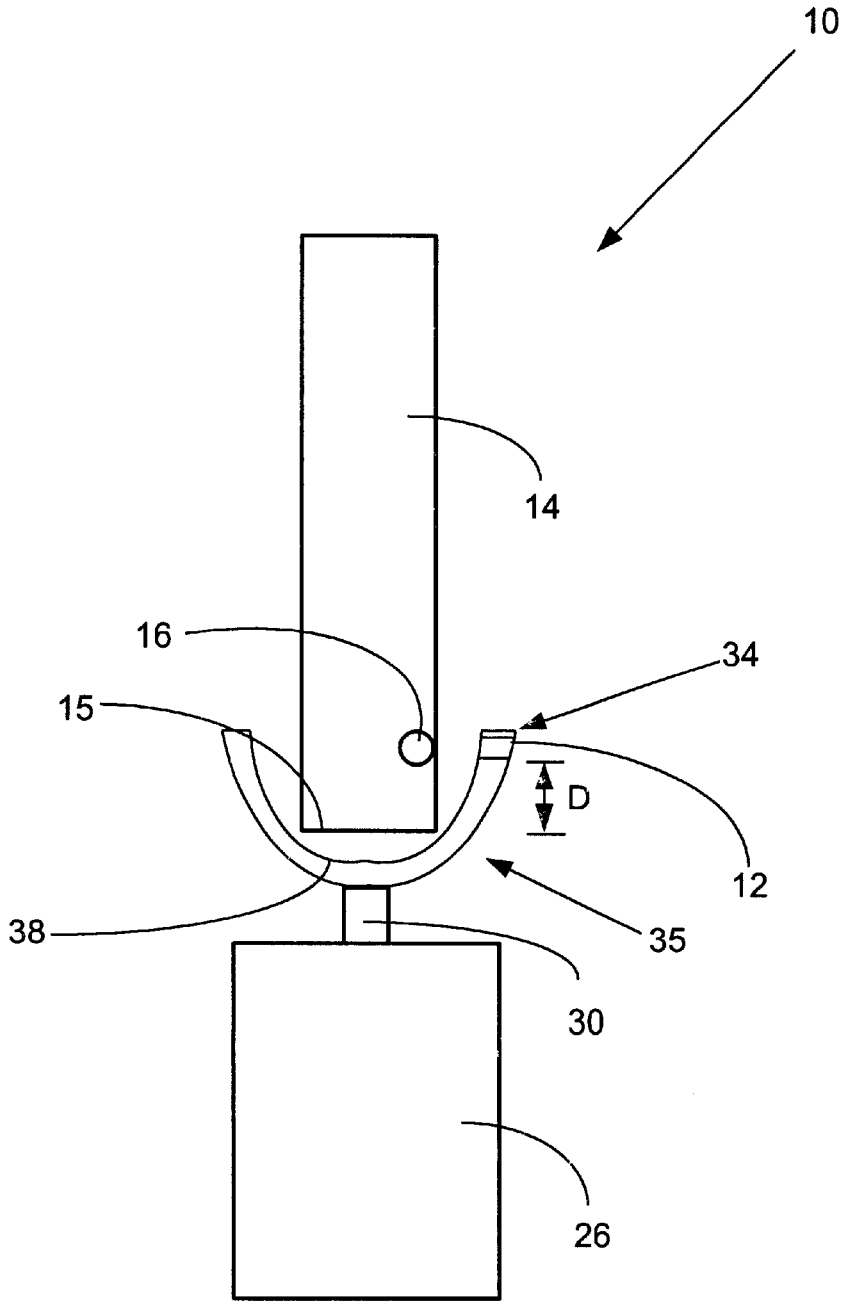
FIG. 4B is a schematic elevation view of another alternate exemplary magnetic mixing apparatus that may be used to advantage in practicing the present invention with a cup-shaped bracket.

FIG. 4 illustrates an embodiment wherein the circumference of rotation of the mixing member 16 actually located above the bottom of the liquid container 14. In this embodiment illustrative of the present invention, the magnetic field source 12 is located in an upper arm 34 of a U-shaped (FIG. 4), L-shaped (FIG. 4A) or cup-shaped (FIG. 4B) bracket 35 around the liquid container and the bottom section 38 of bracket 35 is attached to the rotating shaft 30 of motor 26. In such an embodiment, the magnetic field source 12 is rotated at a distance above the bottom 15 of the tube 14 as distinct to the embodiment of FIG. 1 In which the magnetic field source 12 is rotated at a distance below the bottom 15 of the tube 14. All of these alternate embodiments have been found to be effective, with the only requirement that the magnetic field generated by the magnetic field source be effective in generating motion of the mixing member 16 in response to spatial changes in the magnetic field generated by the revolving magnetic field source 12.

In all embodiments, mixing member 16 is formed from a ferromagnetic or semi-ferromagnetic material and simple rotation of magnet 12 by motor 26 produces corresponding revolving magnetic field forces upon mixing member 16 in container 14. Magnet 12 may for example be a permanent magnet formed of neodymium-iron-boron (NdFeB) or other similar materials. Successful mixing of a low viscosity, water based liquid solution has been accomplished in about ½ second using a 5000 rpm motor 26, from Maxon Motor Co., Fall River, Mass., with a ¼ inch diameter×⅜ inch long permanent magnet 12 having field strength 4000 gauss at a distance of about ⅙ inch.

FIG. 5 is an exemplary illustration of a ball-like mixing member 16 comprising an inner core 40 of ferromagnetic or semi-ferromagnetic material like an iron alloy and may be optionally coated with a thin layer 42 of protective, waterproof material like plastic, paint, epoxy, and the like. Such a ball-like mixing member 12 is very low in cost, typically less than 1 cent, and may be obtained from sources like the Epworth Mill, South Hoover, Mich., as a SAE-52100 Chrome Alloy Spherical Grinding Ball. Various plastic layers 42 like Surlyn™, polyethylene, or parylene may be coated over the surface of mixing member 16 at a thickness of about 25 microns for the purpose of avoiding contamination (rust, iron oxide, etc.) and thereby maintaining the integrity of a liquid solution. Such coating services are available from, for example, PCS, Katy, Tex. In use, a number of these mixing members 16 may be supplied in a straw-like magazine and automatically dispensed into the liquid container 14 using any one of a number of conventional dispensers. Alternately, the mixing members 16 may be pre-disposed within the liquid container 14 before presentation to the magnetic mixing apparatus 10 and a number of liquid containers 14 may be supported in a conventional tube rack so that the liquid solution in the liquid container 14 may be uniformly mixed without removing the liquid containers 14 from the rack.

In an operative example of the present method for mixing a liquid solution using magnetic mixing apparatus 10 by placing a small, spherically shaped magnetic mixing member 16 within the liquid solution and revolving a magnetic field at high speed in a circular pattern at close proximity to the liquid container 14, a liquid solution 18 of water and red food dye was placed in a glass test tube having diameter about 0.6 inches. A magnetic mixing member 16 formed of 52100 chrome alloy having a diameter within the range 2–6 mm was added to the solution and the liquid container 14 placed in a mixer block 22 like that shown in FIG. 1 and shaped out of Delrin™ polymeric material. A cylindrical permanent magnet of size about ¼-inch by ⅜-inch was attached to a motor shaft and the motor supported within the mixer block so that the magnet was about 1/16-inch below the bottom of the test tube. The motor was rotated for about ½-second at 5000 rpm and the distribution of dye within the solution was observed to be thoroughly and uniformly distributed.

Figure 6:
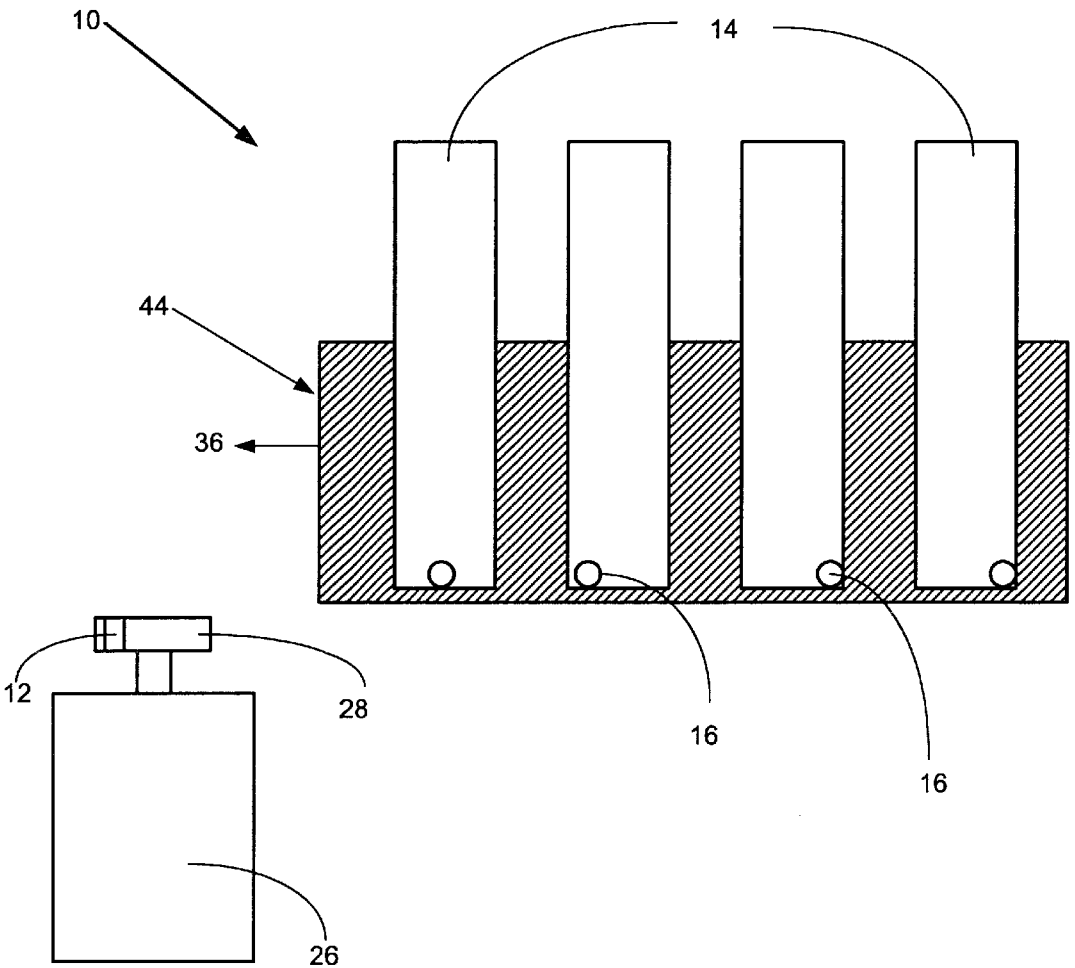
FIG. 6 is a schematic elevation view of a magnetic mixing apparatus that may be used to mix a number of liquid solutions without removing their containers from a support rack when practicing the present invention.
Figure 7:
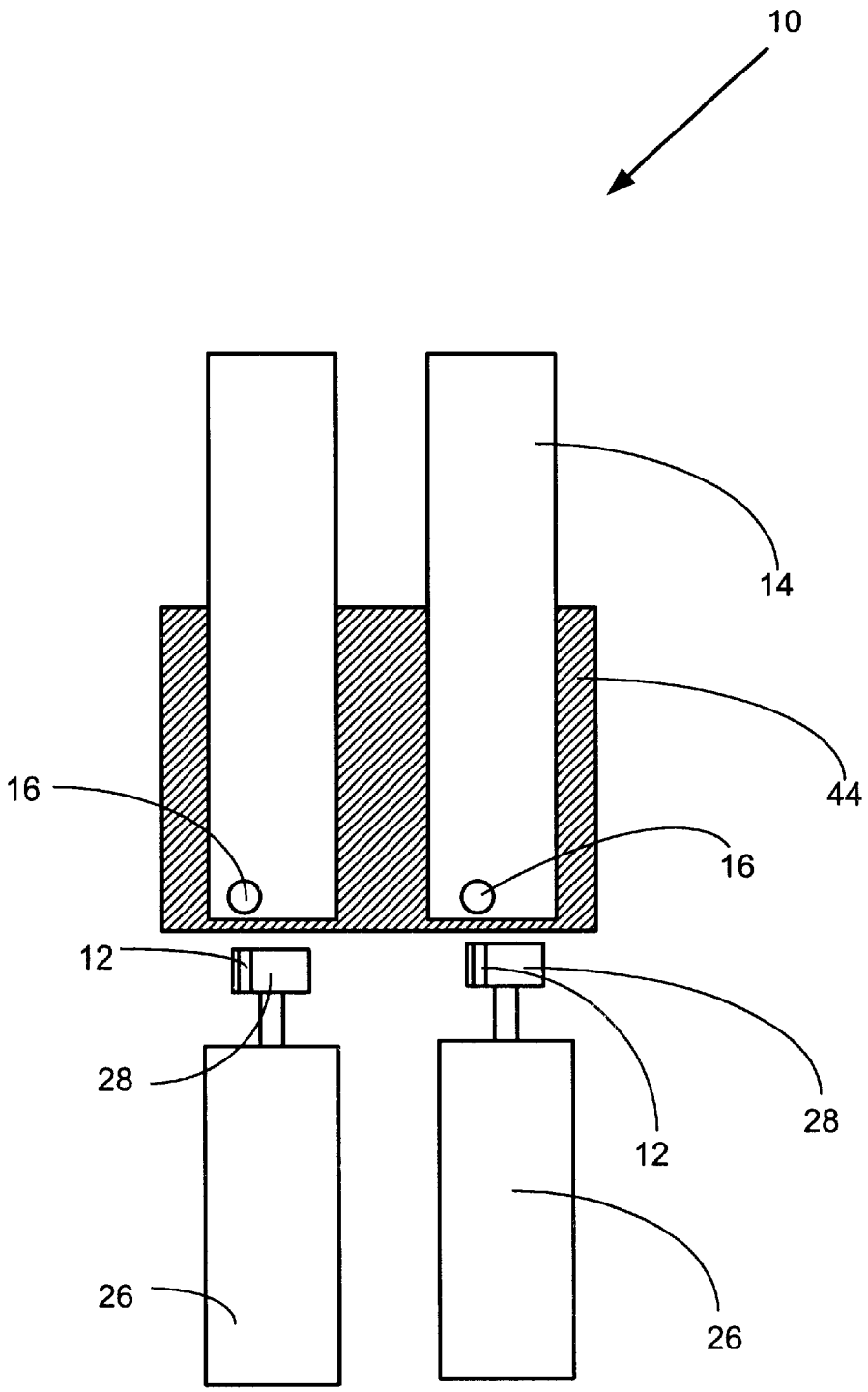
FIG. 7 is a schematic elevation view of an alternate magnetic mixing apparatus that may be used to mix a number of solutions without removing their containers from a support rack when practicing the present invention; and, FIG. 8 is a schematic elevation view of another alternate magnetic mixing apparatus that may be used to mix a number of solutions without removing their containers from a support rack using a single mixer when practicing the present invention.
Figure 8:
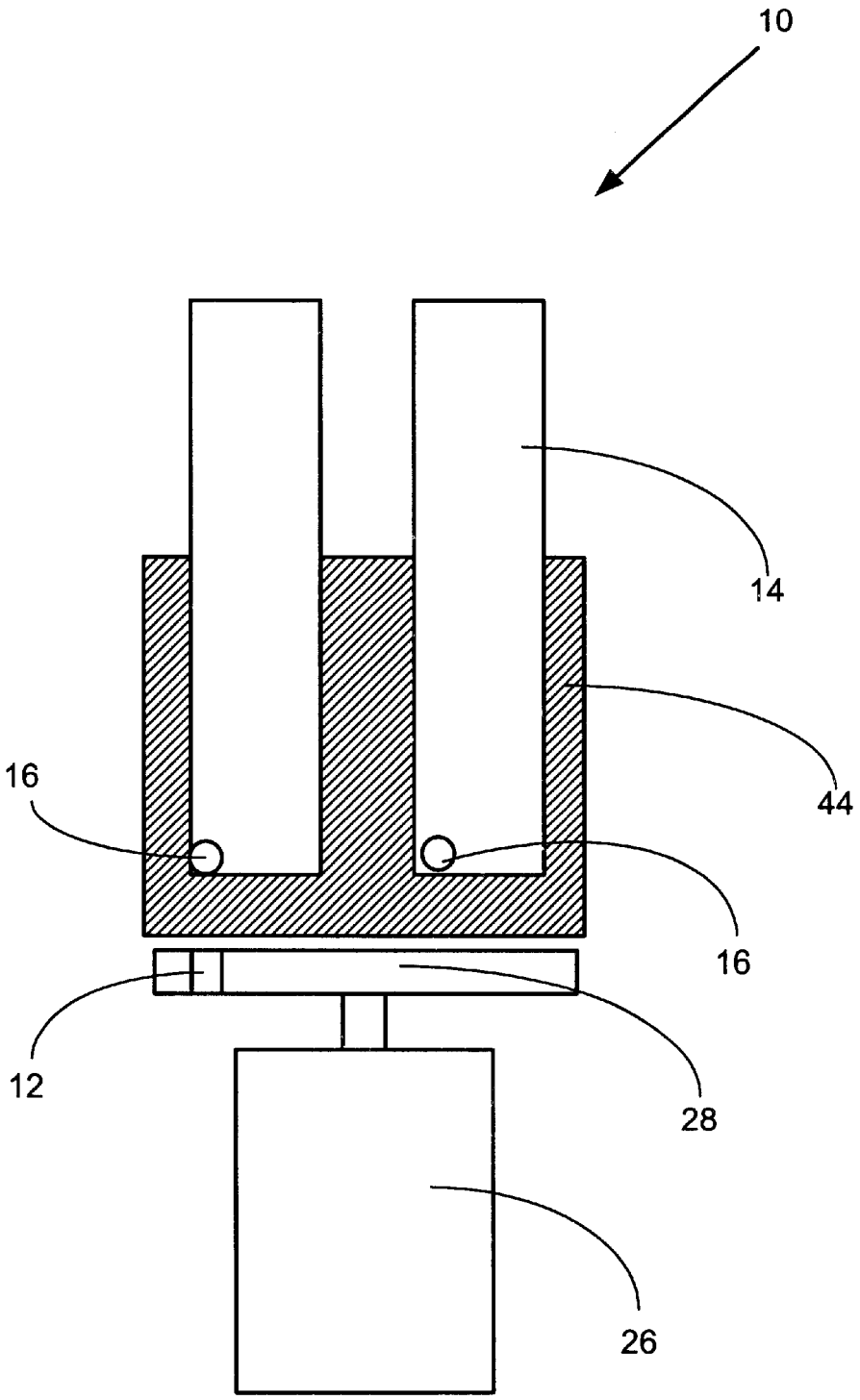

In another exemplary embodiment of magnetic mixing apparatus 10, a number of liquid containers 14 may be placed in a multiple-tube mixer rack 44, as seen in FIG. 6 adapted to accommodate a number of tube-like liquid solution containers 14 in a linear array. Rack 44 is transported in the direction shown by arrow 36 past and above the revolving magnetic field source 12 so that the bottom of the solution containers 14 each having mixing members 16 therein is positioned a distance of about ¼-inch away from the revolving magnetic field source 12. The mixing stand 22 (FIG. 1) may advantageously be formed of an injectable plastic material like nylon or Delrin™ polymers or machined from a nylon-like material. In this instance, the mixer rack 44 may be transported above the magnetic mixing member 16 and the liquid solution within liquid containers 14 mixed in series as the individual liquid containers 14 are positioned proximate thereto. In such an embodiment, the necessity for removing individual liquid containers 14 from rack 44 as is conventional within analytical laboratories to a separate location is eliminated, thereby saving operating space and the expense of additional automated mechanisms. In an equivalent embodiment of magnetic mixing apparatus 10, as seen in the front elevation view of FIG. 7, in the instance that more than one row of liquid containers 14 are contained in rack 44, an equal number of disks 28 encasing magnetic field sources 12 may be positioned proximate thereto and the block 44 transported thereover to effect multiple mixing processes, again without removing the liquid containers 14 from rack 44. Alternately, as seen in FIG. 8, a single rotating disk 28 encasing the magnetic field source 12 may be positioned beneath and approximately equidistance from each of two rows in a dual-row mixing rack 44 and rack 44 transported above the disk 28 in a direction perpendicular to the plane of the printed paper to effect a multiple mixing scheme with only a single rotating disk 28. In an even more efficient mixing scheme, an array of disks 28 may be coupled together using a gear train so that a multiple array of liquid containers 14 to affect the simultaneous uniform mixing of a number of liquid containers 14.

It is to be understood that the embodiments of the invention disclosed herein are illustrative of the principles of the invention and that other modifications may be employed which are still within the scope of the invention. For example, obvious variants of the invention include replacing the permanent magnetic field with an circular electromagnetic field source and varying the time-intensity pattern of power supplied thereto, employing a non-spherical mixing member, eliminating the mixer block and presenting the revolving magnetic field to a tube in a rack, replacing the bracket with a cup, etc. Accordingly, the present invention is not limited to those embodiments precisely shown and described in the specification but only by the following claims.

What is claimed is:

1. A method for mixing a liquid solution, the method comprising:

providing a container having a bottom with the liquid solution therein;

freely disposing a spherical ferromagnetic mixing member within the container; and, revolving a U-shaped, L-shaped or cup-shaped bracket having an upper arm portion in a circular pattern around the outside of and in close proximity to the container, the bracket having and a permanent or semi-permanent magnet for generating magnetic forces attached to the upper arm portion, the magnet and the upper arm portion being disposed distance above the bottom of the container, so that magnetic forces acting upon the mixing member cause the mixing member to revolve said distance above the bottom of the container, thereby generating a mixing motion within the liquid solution.

2. The method of claim 1 wherein the mixing member is made of an iron alloy and has a diameter in the range 2–6 mm.

3. The method of claim 1 wherein the mixing member has a protective coating to prevent contamination thereon, the coating having thickness about 25 microns.

4. A method for mixing a liquid solution, the method comprising:

providing a container having a bottom with the liquid solution therein;

freely disposing a spherical ferromagnetic mixing member within the container; and, supporting the container with a rack; transporting the rack proximate a magnetec field;

revolving the magnetic field in a circular pattern outside of and in close proximity to the container;

so that magnetic forces acting upon the mixing member cause it to revolve within the container thereby generating a mixing motion within the liquid solution.

5. The method of claim 4 wherein the mixing member is made of an iron alloy and has a diameter in the range 2–6 mm.

6. The method of claim 4 wherein the mixing member has a protective coating to prevent contamination thereon, the coating having thickness about 25 microns.

7. An apparatus for mixing a liquid solution contained in a liquid container, the apparatus comprising:

a container having a bottom with the liquid solution therein;

a spherical ferromagnetic mixing member freely disposed within the container;

a permanent or semi-permanent magnet; and, means for revolving a U-shaped, L-shaped or cup-shaped bracket in a circular pattern around the outside of and in close proximity to the liquid container, the bracket having an upper arm portion with the permanent or semi-permanent magnet attached to the upper arm portion, the magnet and the upper arm portion being disposed a distance above the bottom of the container, so that magnetic forces acting upon the mixing member cause it to revolve said distance above the bottom of the container and generate a mixing motion within the liquid solution.

8. The apparatus of claim 7 wherein the mixing member is made of an iron alloy and has a diameter in the range 2–6 mm.

9. The apparatus of claim 7 wherein the mixing member has a protective coating to prevent contamination thereon, the coating having thickness about 25 microns.

* * * * *